US008627752B2

(12) United States Patent
Saad et al.

(10) Patent No.: US 8,627,752 B2
(45) Date of Patent: Jan. 14, 2014

(54) TOOL FOR CUTTING CEILING TILE GRID STOCK AND METHOD OF CUTTING USING THE TOOL

(76) Inventors: William Saad, Westmont, IL (US); Charles F. Picha, Westmont, IL (US)

( * ) Notice: Subject to any disclaimer, the term of this patent is extended or adjusted under 35 U.S.C. 154(b) by 910 days.

(21) Appl. No.: 12/653,717

(22) Filed: Dec. 16, 2009

(65) Prior Publication Data

US 2011/0138738 A1 Jun. 16, 2011

(51) Int. Cl.

| | |
|---|---|
| ***B26B 17/00*** | (2006.01) |
| ***B26B 13/00*** | (2006.01) |
| ***B26B 3/00*** | (2006.01) |
| ***B26B 1/00*** | (2006.01) |
| ***B26D 1/00*** | (2006.01) |

(52) U.S. Cl.
USPC ..... 83/13; 30/250; 30/278; 30/178; 30/131

(58) Field of Classification Search
USPC ..... 83/196–200, 693–696; 30/250, 252, 30/258, 259, 92, 363, 178, 254, 131, 30/278–279
IPC ..... B26B 13/00
See application file for complete search history.

(56) References Cited

U.S. PATENT DOCUMENTS

| | | | | | |
|---|---|---|---|---|---|
| 2,179,732 | A * | 11/1939 | Scanlon | 30/252 |
| 3,914,864 | A * | 10/1975 | Prince | 30/90.6 |
| 4,106,195 | A * | 8/1978 | Berg | 30/293 |
| 4,876,795 | A * | 10/1989 | Chun-cheng | 30/254 |
| 5,542,182 | A * | 8/1996 | Martinez | 30/179 |
| 5,673,487 | A * | 10/1997 | Malagnoux | 30/179 |
| 5,913,575 | A * | 6/1999 | Lai | 30/229 |
| 6,049,985 | A * | 4/2000 | Gonzalez et al. | 30/233 |
| 6,115,922 | A * | 9/2000 | Kline | 30/229 |
| 6,145,203 | A * | 11/2000 | Appleman | 30/233 |
| 6,308,421 | B1 * | 10/2001 | Wang | 30/178 |
| 6,553,878 | B2 * | 4/2003 | Gosis et al. | 83/13 |
| 6,840,146 | B2 * | 1/2005 | Gosis et al. | 83/199 |
| 7,328,513 | B1 * | 2/2008 | Yang | 30/178 |
| 2005/0198833 | A1 * | 9/2005 | Lin | 30/131 |
| 2007/0289140 | A1 * | 12/2007 | Marcon | 30/92 |
| 2009/0188118 | A1 * | 7/2009 | Swinford | 30/252 |

* cited by examiner

*Primary Examiner* — Ghassem Alie
*Assistant Examiner* — Bharat C Patel
(74) *Attorney, Agent, or Firm* — Wood, Phillips, Katz, Clark & Mortimer

(57) ABSTRACT

A tool and a method for cutting an elongate runner piece used to support a ceiling tile and having an inverted T-shaped body and including: a) a crossbar having a downwardly facing surface with a width; and b) a stem. The method includes the steps of: providing a tool with a support assembly and cutting assembly; placing the runner piece in a cutting position upon the support assembly; with the rail piece in the cutting position, repositioning at least one cutting element on the cutting assembly to thereby cut into the crossbar on the body over substantially the full width of the downwardly facing surface of the crossbar at a first lengthwise location; and cutting the stem adjacent to the first lengthwise location.

15 Claims, 4 Drawing Sheets

TOOL FOR CUTTING CEILING TILE GRID STOCK AND METHOD OF CUTTING USING THE TOOL

BACKGROUND OF THE INVENTION

1. Field of the Invention

This invention relates to ceiling tile installation and, more particularly, to a tool for cutting elongate runner stock material used to support such tiles.

2. Background Art

Ceiling tiles are commonly used in both commercial and residential applications. The tiles are installed by forming a grid pattern on site at the desired height for the tiles. Grid stock material consists of elongate metal runners with an inverted "T"-shaped cross-sectional configuration. The upwardly facing surfaces on the crossbars of the "T" in the grid cooperatively define a cradle for the individual tiles. The bottom surfaces of the crossbars of the "T" remain exposed with the tiles in place and are thus finished, as by painting, to produce a desired look in conjunction with the supported tiles.

The use of acoustic tiles in ceiling construction is preferred for a number of reasons. First of all, a substantial amount of flexibility is offered in terms of aesthetics. Tiles with many different looks, textures, colors, etc are currently offered, thereby making numerous aesthetic options readily available.

Ceiling tiles can also be selected for their acoustic properties. Most tile constructions are made with a substantial thickness and from materials with good sound absorption characteristics.

Ceiling tile construction is also preferred in that it lends itself to being readily placed through a range of heights that can be selected to efficiently accommodate water pipes, electrical conduits, or other structure at the ceiling location that is to be covered by the tile ceiling.

The tile ceiling construction is also desirable from the standpoint that the tiles can be simply installed once the grid is constructed. At the same time, after initial installation, the individual tiles are easily repositioned to gain strategic access to different overlying components or regions to allow desired operations to be performed. These operations may include repair of existing components, installation of new components or systems, etc.

Grid formation is carried out by suspending crossing runners from wire hangers. Multiple lengths of the runner stock can be spliced end-to-end to span the whole dimension of a ceiling area. At least one of the runner ends must generally be cut to terminate flushly at a wall or another vertically extending surface at the level of the ceiling. Installing a ceiling of this type over a large area may require that a large number of such cuts be made at the crossing runner ends.

Heretofore, the runner ends have been cut to length using a conventional snips. Different cutting techniques using the snips are commonly used.

One such technique involves placing a visible line on the downwardly facing, finished surface on the crossbar of the "T" shape. Separate cuts can be made from the opposite edges of the crossbar towards the stem of the crossbar. A separate cut can then be made through the stem. It is difficult to form all cuts so that they meet in a manner that there is a complete severance of the unwanted length. Commonly, the unwanted length is repeatedly bent back and forth to weaken, and eventually cause failure, of any uncut connecting portion. Upon eventual separation, a slight burr may remain that may cause an impediment to a close fit and/or detract from the appearance of the cut region where it is exposed in the finished installation.

In the event that there is not a good fit that results after the cut is made, a subsequent trim cut may be required involving a repetition of the above steps. It may be even more difficult to effect the subsequent trimming cut in a manner to produce a straight, clean edge that does not have a jagged appearance.

Regardless of the care taken in making the cut, the pinching action resulting from the use of a snips inherently tends to produce a slight curling at the cut edge. This by itself may detract from the appearance of the runner at this location and may additionally compromise the paint or other finish that is applied at the exposed surface of the crossbar of the "T". These problems may be aggravated in the event that the snips are not of good quality or are not properly sharpened.

The use of a conventional snips to effect the cutting is made difficult by the shape of the runner material. Commonly, the runners are made from sheet metal stock that is doubled against itself at certain locations. The mix of different thicknesses may cause skewing of the snips as cutting is carried out, and may also cause the runner end to bend noticeably.

Techniques other than that specifically described above may be used to cut the runner material with conventional snips. However, regardless of the technique employed, the above-noted problems are generally contended with.

Additionally, aside from the fact that it is difficult to precisely cut the ends of the runners without any aesthetically detrimental effect, the cutting process is inherently inconvenient and relatively time consuming. Severance of the runner material generally involves at least three different steps—separate cutting of the crossbar halves to the stem, and subsequently severing of the stem of the "T". With shorter lengths, the runner material might be conveniently repositioned by an installer to allow the runner piece to be conveniently situated for repeated cutting steps. With a long runner piece, the individual effecting the cut may be required to reposition him/herself to achieve a comfortable cutting position.

On small projects, the above problems may not be significant in terms of overall time loss. However, in large commercial installations, the accumulated time loss may be significant. In a worse case, after inspection of a completed job, follow-up work may be required to dress unsightly edges or re-cut materials, thereby further reducing efficiencies.

In spite of the large volume of such installations, the industry continues to contend with the above problems because no viable alternative techniques or tools have been devised to overcome the same.

SUMMARY OF THE INVENTION

In one form, the invention is directed to a method of cutting an elongate runner piece used to support a ceiling tile and having an inverted T-shaped body with a width and including: a) a crossbar having a downwardly facing surface with a width; and b) a stem. The method includes the steps of: providing a tool with a support assembly and cutting assembly; placing the runner piece in a cutting position upon the support assembly; with the runner piece in the cutting position, repositioning at least one cutting element on the cutting assembly to thereby cut into the crossbar on the body over substantially the full width of the downwardly facing surface of the crossbar at a first lengthwise location; and cutting the stem adjacent to the first lengthwise location so that the runner piece can be separated into two pieces.

In one form, the crossbar on the body has first and second upwardly facing surfaces between which the stem resides and the step of providing a tool involves providing a tool wherein the support assembly has first and second support surfaces between which a receptacle is defined. The step of placing the runner piece in the cutting position involves situating the stem of the body within the receptacle and the first and second upwardly facing stem surfaces respectively against the first and second support surfaces.

In one form, the crossbar on the body has spaced first and second widthwise edges and the step of providing a tool involves providing a tool wherein the support assembly has a first blocking edge. The step of placing the runner piece in the cutting position involves placing the first widthwise edge of the crossbar in confronting relationship with the first blocking edge to thereby limit movement of the runner piece in one direction widthwise relative to the support assembly.

In one form, the step of providing a tool involves providing a tool in which the support assembly includes a second blocking edge spaced from the first blocking edge. The step of placing the runner piece in the cutting position involves placing the second widthwise edge of the crossbar in confronting relationship with the second blocking edge to thereby limit movement of the runner piece in a direction opposite to the one direction widthwise relative to the support assembly.

In one form, the step of providing a tool involves providing a tool wherein the first and second blocking surfaces are spaced from each other a distance slightly greater than a distance between the first and second widthwise edges of the crossbar so that the crossbar can be fit between the first and second blocking edges.

In one form, the step of providing a tool involves providing a tool in which the receptacle is bounded by a first surface. The step of placing the runner piece in the cutting position involves placing the stem in confronting relationship with the first surface to thereby limit movement of the stem in one direction widthwise relative to the support assembly.

In one form, the step of providing a tool involves providing a tool in which the receptacle is bounded by a second surface that faces the first surface. The step of placing the runner piece in the cutting position involves placing the stem, in confronting relationship with the second surface to thereby limit movement of the stem in a direction opposite to the one direction widthwise relative to the support assembly.

In one form, the step of repositioning the at least one cutting element involves causing a cutting edge on the at least one cutting element to move up to and beyond the first and second support surfaces.

In one form, the step of providing a tool involves providing a tool in which the cutting edge is moved in an arcuate path as the cutting edge moves up to and beyond the first and second support surfaces.

In one form, the step of providing a tool involves providing a tool with first and second handles. The step of repositioning the at least one cutting element involves grasping the first and second handles in one hand and squeezing the first and second handles so as to move the first and second handles, one towards the other.

In one form, the step of repositioning the at least one cutting element involves repositioning the at least one cutting element so that the at least one cutting element cuts fully through the crossbar and partially through the stem.

In one form, the step of cutting the stem involves cutting the stem other than by using the tool.

In one form, the step of providing a tool involves providing a tool in which the first and second support surfaces are substantially flat and co-planar.

In one form, the step of providing a tool involves providing a tool with a support assembly having a first platform. The method further includes the step of providing a second platform that is configured to accommodate a runner piece with a configuration different than is accommodated by the first platform and interchangeable with the first platform.

In one form, the method further includes the step of holding the cutting tool in one hand as the at least one cutting element is repositioned.

In one form, the invention is further directed to a combination including: a) a length of runner used to support a ceiling tile and having an inverted T-shaped body with a width, the body consisting of: i) a crossbar having a downwardly facing surface with a width; and ii) a stem; and b) a tool including: a support assembly having a receptacle and first and second support surfaces; and a cutting assembly having at least one cutting element movable between first and second positions. The length of runner is situated in a cutting position in which the stem projects into the receptacle and the crossbar of the body is supported against the first and second support surfaces. With the length of runner in the cutting position, the cutting element is movable between the first and second positions to cut into the crossbar substantially over the full width of the downwardly facing surface.

In one form, the crossbar has first and second spaced widthwise edges and the support assembly includes first and second spaced blocking edges. With the length of runner in the cutting position, the first and second crossbar edges respectively confront the first and second blocking edges to limit movement of the length of runner in opposite widthwise directions relative to the support assembly.

In one form, the receptacle is bounded by first and second facing surfaces and with the length of runner in the cutting position, the stem confronts the first and second facing surfaces to limit movement of the length of runner in opposite widthwise directions relative to the support assembly.

In one form, the tool includes first and second handles that are graspable in a hand of a user and, upon being squeezed, cause the at least one cutting element to be moved from the first position into the second position.

In one form, the support assembly includes a first platform. The combination further includes a second platform that is configured to accommodate a runner length with a configuration different than is accommodated by the first platform and interchangeable with the first platform.

DETAILED DESCRIPTION OF THE PREFERRED EMBODIMENT

Figure 1:
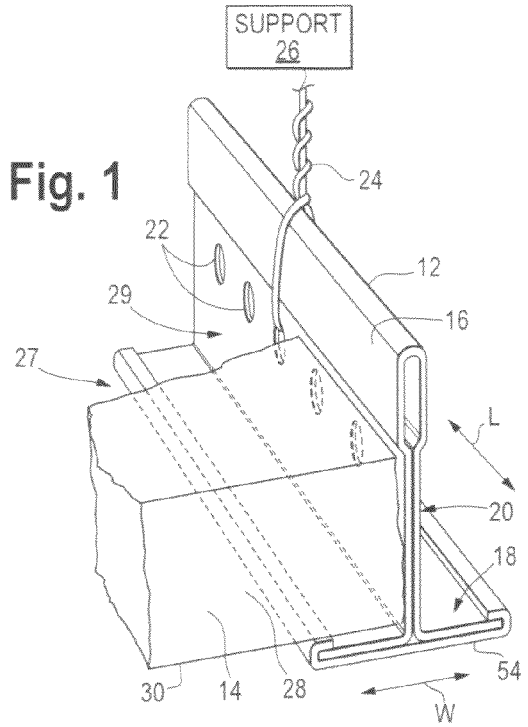
FIG. 1 is a fragmentary, perspective view of a portion of a ceiling consisting of a tile and a piece of an elongate runner that supports the tile.

In FIGS. 1-9, a tool, according to the invention, is shown at 10 for cutting an elongate runner piece/length 12 that makes up part of a grid used to support a series of ceiling tiles 14.

The runner piece 12 depicted is exemplary of a number of different configurations therefor used to support ceiling tiles 14. The runner piece 12 has an inverted, "T"-shaped body 16 with a width dimension, as indicated by the double-headed arrow W, and a length dimension, as indicated by the double-headed arrow L. The body 16 consists of crossbar 18 and a stem 20 that is orthogonally oriented with respect to the crossbar 18 to produce the "T" shape.

The stem 20 is provided with a series of apertures 22 that are spaced in a lengthwise direction and through which a hanging wire 24 can be directed. The lower end of the wire 24 can be projected through one of the apertures 22, doubled back against itself, and twisted to be secured as depicted in FIG. 1. The opposite wire end can be suitably secured to a support 26 to maintain the runner piece 12 at a desired operative height. Runner pieces 12 of similar construction are hung to produce a grid pattern over the areal extent of the ceiling within the surrounding walls.

Typically, the ceiling tiles 14 will have a rectangular or squared shape over the majority of the ceiling area. The runner pieces 12 are strategically arranged so that they cross to produce a series of openings 27 corresponding to the shape of the individual tiles 14. The perimeter edge 28 of each tile 14 is nominally matched to a space 29 bounded by four lengths of the stem 20 extending around each opening. With this arrangement, the downwardly facing surface 30 on each tile 14 is supported cooperatively by the crossbars 18 extending around the respective tile opening 27. Different tile opening shapes may be defined around the perimeter of the ceiling.

The full lengthwise extent of a runner between facing walls may be made up of multiple pieces 12. Generally, one or both lengthwise ends of the runner will need to be cut to flushly abut to a bounding wall surface.

Figure 11:
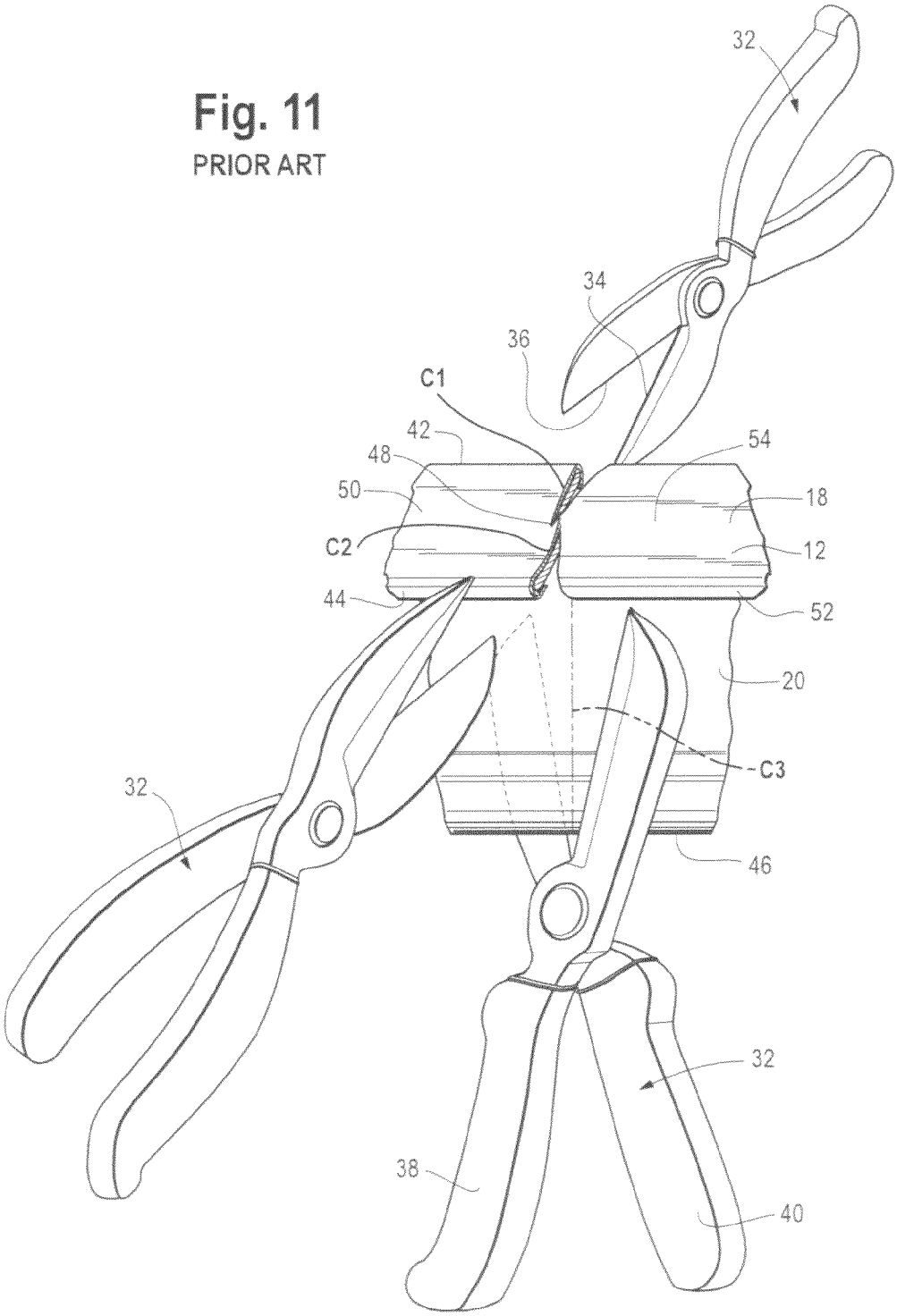
Fig. 11 PRIOR ART
FIG. 11 is a fragmentary, perspective view of a length of runner being cut conventionally by using snips and making three separate cuts.

As described above, heretofore, cutting of the "T"-shaped runner pieces 12 has been carried out as shown, for example, in FIG. 11. In FIG. 11, a typical metal cutting snips 32 is used to make three separate cuts identified as C1, C2, and C3. The snips 32 is shown to be operable in the same manner as a scissors and includes cooperating cutting edges 34, 36 that are moved in an arcuate path towards each other, to produce a pinching cutting action, by squeezing handle parts 38, 40 together, as in a user's one hand.

One technique for cutting involves forming the cut C1 from one widthwise edge 42 of the crossbar 18 up to adjacent the stem 20. The cut C2 is formed by progressively severing the crossbar 18 from the opposite widthwise edge 44 of the crossbar 18 up to the vicinity of the stem 20. The third cut C3 is effected by progressively severing the stem 20 from the bottom edge 46 thereof up to the crossbar 18.

Typically, this will leave an uncut region at 48. The uncut region at 48 may be severed by repeatedly bending the runner portion 50 that is to be removed relative to the runner portion 52 that is to be cut to a desired length. This repeated bending weakens the uncut region 48 to the point that it severs.

Practicing this technique, it is difficult, if not impossible, to form the cuts C1, C2 to produce a clean, straight line across the whole width of the crossbar 18. By reason of severing the uncut region 48 in the manner described, a visible burr may remain that is unsightly and also projects to effectively alter the length of the runner portion 52. This is particularly a problem since the downwardly facing surface 54 of the crossbar 18 is exposed to view on the completed installation, as can be seen in FIG. 1. Typically, the downwardly facing surface 54 and the edges 42, 44 are painted or otherwise treated to be aesthetically pleasing and color coordinated with the exposed surfaces 30 of the tiles 14. Jagged formation of the cuts C1, C2 may compromise the pre-finished surfaces 54, regardless of the care taken by, and the skill level of, the installer.

To overcome these problems, the tool 10, as shown in FIGS. 1-9, is configured to make a clean, straight, cut through the downwardly facing surface 54. The tool 10 consists of a support assembly 56, a cutting assembly 58, and an operating assembly 60.

Figure 5:
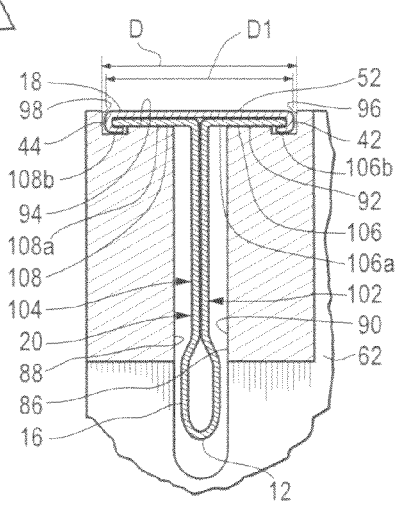
FIG. 5 is a cross-sectional view of the cutting tool with the runner piece in the cutting position taken along line 5-5 of FIG. 4.
Figure 4:
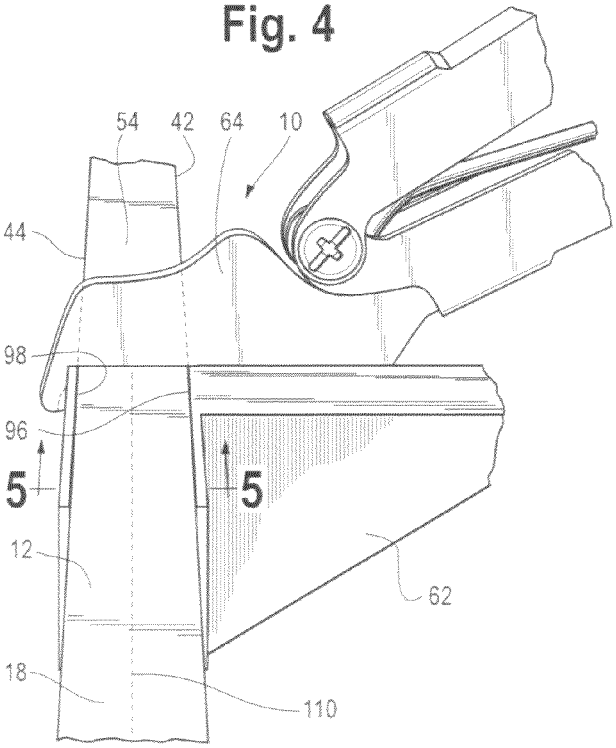
FIG. 4 is a view as in FIG. 3 with the runner piece in the cutting position and the cutting element moved into a second position to cut the runner piece.

The support assembly 56 consists of a platform 62, upon which the runner piece 12 can be placed in a cutting position, as shown in FIGS. 4 and 5.

Figure 3:
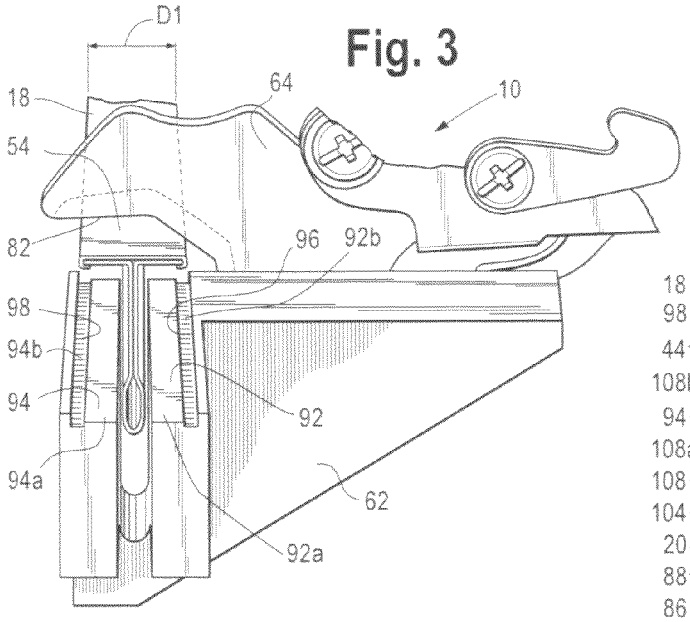
FIG. 3 is a fragmentary, perspective view of the runner piece being directed into the cutting position and with a cutting element in a first position.

The cutting assembly 58 consists of a cutting element 64 that is joined to the platform 62 for guided pivoting movement relative thereto around an axis 65 between a first position, as shown in FIG. 3, and a second position, as shown in FIG. 4.

The operating assembly 60 consists of a linkage 66 that is joined to both the platform 62 and cutting element 64. The linkage 66 is operated through handles 68, 70 that can be grasped in a single hand of an installer and squeezed from the FIG. 2 position to thereby cause the linkage 66 to pivot the cutting element 64 in an arcuate path around the axis 65 from the first position into the second position therefor. The handles 68, 70 respectively have contoured gripping sections 72, 74 formed thereon to contribute to user comfort and facilitate positive gripping of the tool 10 for transportation and operation thereof.

The details of the linkage 66 are not critical to the present invention. The linkage 66 depicted is a conventional linkage used on different hand-operated tools to produce a mechanical advantage as the handles 68, 70 are squeezed in operation.

The cutting element 64 has a flat body 76 with a flat surface 78 that resides in a plane that is parallel to the plane of a flat surface 80 upon the platform 62 as the cutting element 64 is moved between its first and second positions. The surfaces 78, 80 are in close proximity to each other for reasons that will be described hereinbelow.

The cutting element 64 has a cutting edge 82 that is U-shaped. A bevel 84 is formed around the edge 82 to cause the cutting edge 82 to have a thin, sharp shape and also to produce a wedging action during cutting, as hereinafter described. In this embodiment, the cutting edge 82 and bevel 84 are defined by a series of angled, straight lengths L1, L2, L3 that cooperatively define the "U" shape.

The platform 62 has an upwardly opening receptacle 86 with a width bounded by facing surfaces 88, 90. The receptacle 86 is configured to receive the full height of the stem 20 with the runner piece 12 in the cutting position. The receptacle 86 is open vertically to allow the stem 20 to be directed downwardly thereinto to place the runner piece in the cutting position.

To accommodate the crossbar 18 with the runner piece 12 in the cutting position, the platform 62 is undercut to define spaced support surfaces 92, 94 between which the receptacle 86 resides. The support surfaces 92, 94 have stepped surface portions 92*a*, 94*a*; 92*b*, 94*b* that are flat and co-planar and cooperatively conform to the underside of the crossbar 18 to solidly support the crossbar 18 in a vertical direction. The undercut produces a blocking edge 96 at the edge of the support surface 92 and a blocking edge 98 at the edge of the support surface 94.

The blocking edges 96, 98 face each other and are spaced a distance D that is nominally matched to the width D1 of the crossbar 18 between the widthwise edges 42, 44 thereon. The distance D is slightly greater than the distance D1 so that the crossbar 18 can be directed between the blocking edges 96, 98 to place the runner piece 12 in the cutting position wherein it is maintained against skewing.

Figure 2:
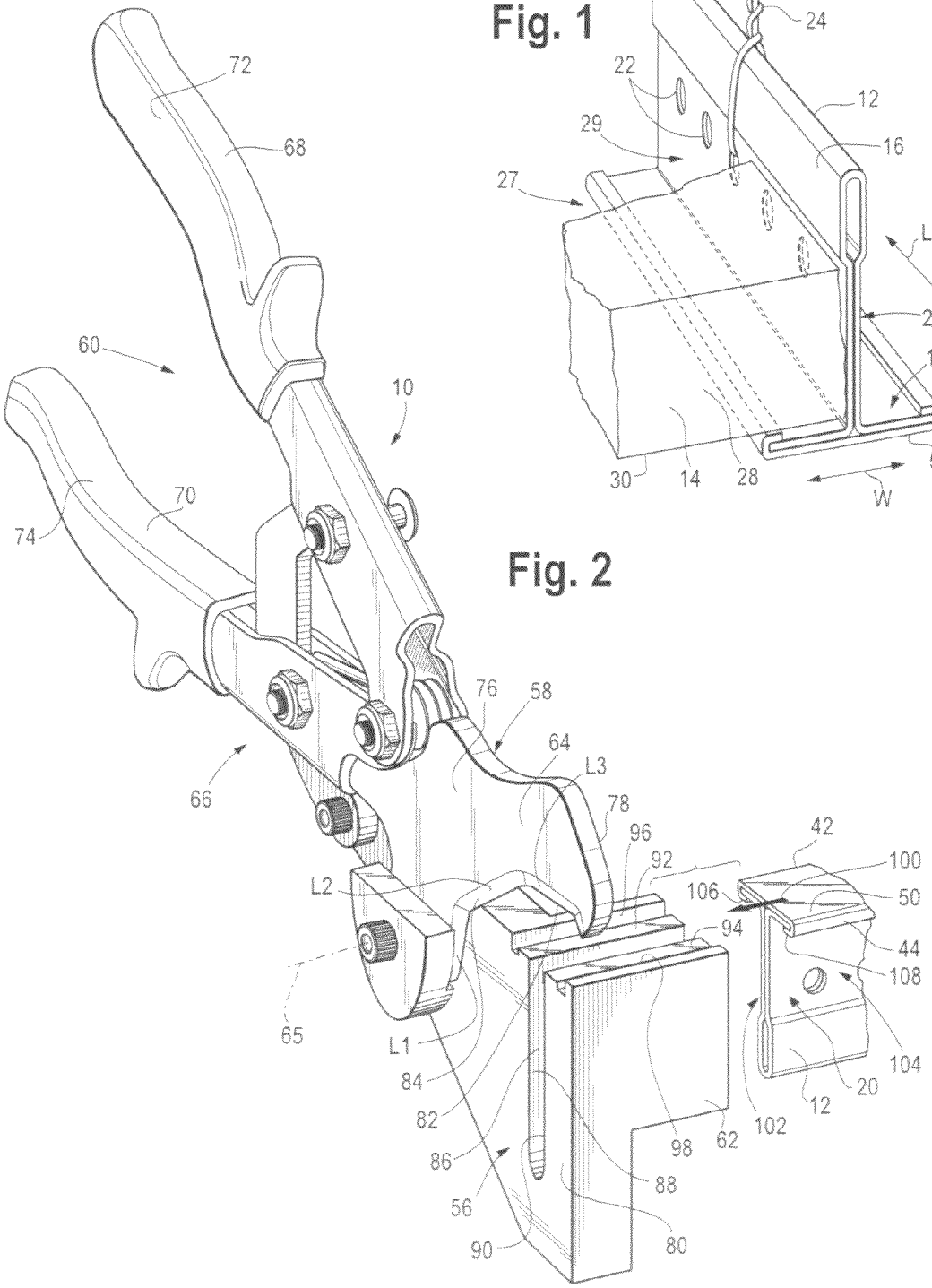
FIG. 2 is a perspective view of a tool for cutting a runner piece as shown in FIG. 1 and with the runner piece being directed into a cutting position thereon.

To initiate a cutting operation, the portion 50 of the runner piece 12 is moved in the direction of the arrow 100 in FIG. 2 towards the platform 62, with the stem 20 aligned with the receptacle 86. Continued movement causes the stem 20 to move into the receptacle 86 so that opposite sides 102, 104 of the stem 20 are placed in confronting relationship with the surfaces 88, 90 bounding the receptacle 86, thereby to limit movement of the stem 20 in opposite widthwise directions relative to the platform 62. Crossbar surfaces 106, 108, between which the stem 20 resides, respectively abut to the support surfaces 92, 94 on the platform 62 so that the runner piece 12 is supported vertically. More specifically, crossbar surface portions 106*a*, 108*a* respectively abut to the platform surface portions 92*a*, 94*a*, with the crossbar surface portions 106*b*, 108*b* respectively abutting to the platform surface portions 92*b*, 94*b*.

The widthwise edges 42, 44 on the crossbar 18 are respectively placed in confronting relationship with the blocking edges 96, 98, thereby to interact to limit widthwise movement of the crossbar 18 in opposite directions relative to the platform 62.

With the runner piece 12 in the cutting position, a lengthwise axis 110 thereof is orthogonal to the planes of the platform surface 80 and the cutting element surface 78. As the cutting element 64 is moved from its first position into its second position, the cutting edge 82 moves in its arcuate path up to, and eventually beyond, the support surfaces 92, 94. As this occurs, the cutting edge 82 progressively severs the crossbar 18 at a longitudinal cutting location where the plane of the cutting edge 82 resides.

The shape of the "U"-shaped cutting edge 82 is such that the portion L2 conforms generally to the downwardly facing surface 54, with the transverse portions L1, L3 wrapping around the crossbar edges 42, 44, as seen most clearly in FIG. 4. The cutting edge 82 is configured so that with the cutting element 64 in its second position, preferably the cutting edge fully severs the crossbar 18 and extends a slight distance into the stem 20. It is contemplated that less than then full thickness of the crossbar 18 might be severed, so long as the downwardly facing surface 54 is severed across substantially its full width.

Figure 6:
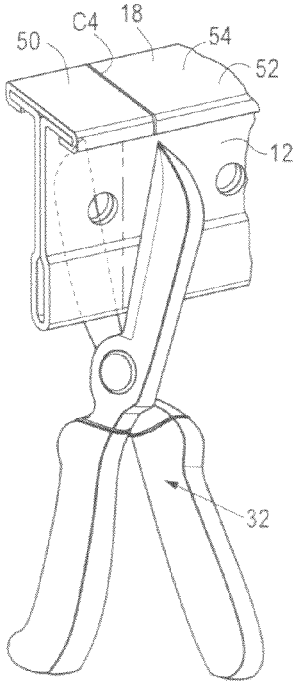
FIG. 6 is a fragmentary, perspective view of the runner piece in FIG. 5 wherein a separate tool is used to sever the uncut portion of the runner piece.

Thereafter, as shown in FIG. 6, a snips 32, as shown in FIG. 11, can be used to sever the remaining portion of the stem 20 to effect full severance of the portion 50 of the runner piece 12 from the portion 52 of the runner piece 12 that is to be cut to length. As can be seen in FIG. 6, a clean and straight cut C4 is formed through the crossbar 18.

Figure 7:
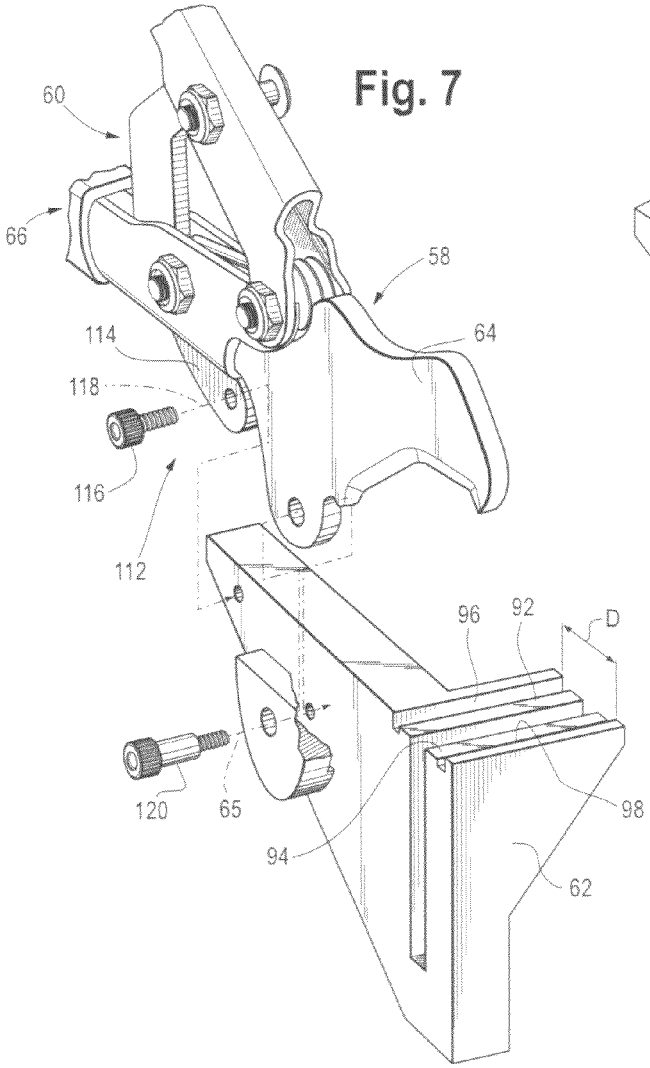
FIG. 7 is an exploded, fragmentary, perspective view of the tool as shown in FIG. 2.

The invention contemplates that a single tool frame 112 (FIG. 7), consisting of the cutting assembly 58 and operating assembly 60, might be modified to accommodate different configurations for the runner pieces to be cut thereby. To permit this, the tool 10 is designed to be reconfigurable by a user. As shown in FIG. 7, a component 114 on the linkage 66 is pivotably mounted to the platform 62 through a removable threaded bolt 116 that defines a pivot axis 118 for that component 114 relative to the platform 62. Similarly, through a removable bolt 120, the cutting element 64 is mounted for guided movement around the axis 65 so that the cutting edge 82 moves in an arcuate path as the cutting element 64 is changed between its first and second positions.

Figure 9:
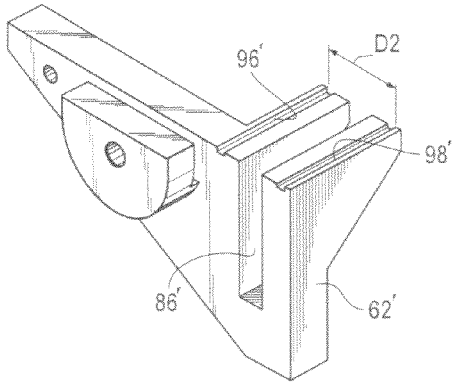
FIG. 9 is a perspective view of a modified form of platform that can be used in place of the platform shown in FIGS. 7 and 8.
Figure 8:
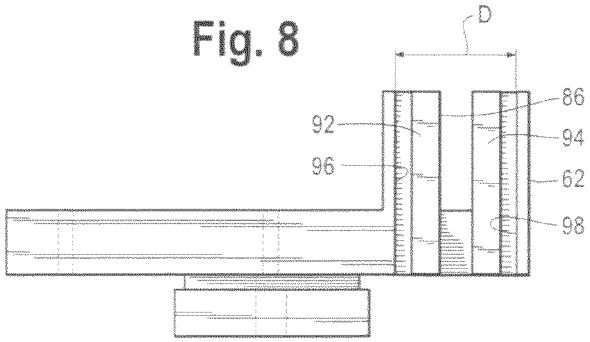
FIG. 8 is a plan view of a platform on the tool, with the platform separated from the remainder of the tool.

By removing the bolts 116, 120, the platform 62 can be separated from the frame 112 and substituted for by a different platform 62', as seen in FIG. 9, that accommodates a runner with a configuration different than is accommodated by the platform 62, as seen in FIG. 8. The difference can be in a difference in the spacing D2 between blocking edges 96', 98', corresponding to the spacing D between the blocking edges 96, 98, and/or a difference in the width or depth of a receptacle 86', corresponding to the receptacle 86. Other differences are contemplated.

By having the ability to interchange the platforms 62, 62', the tool 10 becomes more versatile. Other platforms (not shown) might also be made available to be part of a kit to be substituted for either of the platforms 62, 62'.

Figure 10:
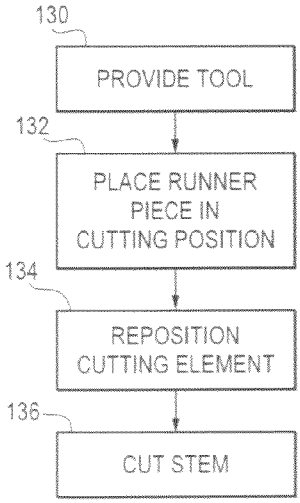
FIG. 10 is a flow diagram representation of a method of cutting an elongate runner piece using the inventive tool.

With the tool as described above, a method of cutting an elongate runner piece can be carried out as shown in flow diagram form in FIG. 10. As shown at block 130, a tool is provided, as described above.

As shown at block 132, the runner piece is placed in a cutting position upon the support assembly on the tool.

As shown at block 134, with the tool held in a user's one hand, the cutting element is repositioned to thereby cut across the crossbar on the runner piece over substantially the full width of the downwardly facing surface thereon at a first lengthwise location.

As shown at block 136, any uncut portion of the stem is severed to separate the runner piece into two pieces.

It should be understood that the tool could be configured so that the cutting element severs not only the crossbar 18 but the full extent of the stem 20 as the cutting element 64 is moved from its first position into its second position.

The foregoing disclosure of specific embodiments is intended to be illustrative of the broad concepts comprehended by the invention.

The invention claimed is:

1. A method of cutting an elongate runner piece for supporting a ceiling tile and comprising an inverted T-shaped body having a width and including: a) a crossbar having a downwardly facing surface with a width; and b) a stem, the method comprising the steps of:

providing a tool with a support assembly and cutting assembly;

placing the runner piece in a cutting position upon the support assembly so that the body is supported by the support assembly by causing the support assembly to bear against the crossbar;

with the runner piece in the cutting position, repositioning at least one cutting element on the cutting assembly so as to cause the at least one cutting element to move up to and against the supported crossbar to thereby cut into the crossbar over substantially the full width of the downwardly facing surface of the crossbar at a first lengthwise location; and cutting the stem adjacent to the first lengthwise location so that the runner piece can be separated into two pieces, wherein the crossbar on the body has first and second upwardly facing surfaces between which the stem resides and the support assembly comprises first and second upwardly facing flat support surfaces between which a receptacle is defined and the step of placing the runner piece in the cutting position comprises situating the stem of the body within the receptacle and the first and second upwardly facing crossbar surfaces respectively against the first and second upwardly facing flat support surfaces, and wherein the first and second upwardly facing flat support surfaces extend along and bear against a substantial length of the crossbar with the runner piece in the cutting position so as to thereby solidly support the runner piece in the cutting position in a consistent orientation on the support assembly and relative to the cutting element.

2. The method of cutting an elongate runner piece according to claim 1 wherein the crossbar on the body has spaced first and second widthwise edges and the support assembly comprises a first blocking edge and the step of placing the runner piece in the cutting position comprises placing the first widthwise edge of the crossbar in confronting relationship with the first blocking edge to thereby limit movement of the runner piece in one direction widthwise relative to the support assembly.

3. The method of cutting an elongate runner piece according to claim 2 wherein the support assembly comprises a second blocking edge spaced from the first blocking edge and the step of placing the runner piece in the cutting position comprises placing the second widthwise edge of the crossbar in confronting relationship with the second blocking edge to thereby limit movement of the runner piece in a direction opposite to the one direction widthwise relative to the support assembly.

4. The method of cutting an elongate runner piece according to claim 3 wherein the first and second blocking edges are spaced from each other a distance slightly greater than a distance between the first and second widthwise edges of the crossbar so that the crossbar can be fit between the first and second blocking edges.

5. The method of cutting an elongate runner piece according to claim 1 wherein the receptacle is bounded by a first surface and the step of placing the runner piece in the cutting position comprises placing the stem in confronting relationship with the first surface to thereby limit movement of the stem in one direction widthwise relative to the support assembly.

6. The method of cutting an elongate runner piece according to claim 5 wherein the receptacle is bounded by a second surface that faces the first surface and the step of placing the runner piece in the cutting position comprises placing the stem in confronting relationship with the second surface to thereby limit movement of the stem in a direction opposite to the one direction widthwise relative to the support assembly.

7. The method of cutting an elongate runner piece according to claim 1 wherein the step of repositioning the at least one cutting element comprises causing a cutting edge on the at least one cutting element to move up to and beyond the first and second support surfaces.

8. The method of cutting an elongate runner piece according to claim 7 wherein the cutting edge is moved in an arcuate path as the cutting edge moves up to and beyond the first and second support surfaces.

9. The method of cutting an elongate runner piece according to claim 7 wherein the tool comprises first and second handles and the step of repositioning the at least one cutting element comprises grasping the first and second handles in one hand and squeezing the first and second handles so as to move the first and second handles one towards the other.

10. The method of cutting an elongate runner piece according to claim 1 wherein the step of repositioning the at least one cutting element comprises repositioning the at least one cutting element so that the at least one cutting element cuts fully through the crossbar and partially through the stem.

11. The method of cutting an elongate runner piece according to claim 1 wherein the step of cutting the stem comprises cutting the stem other than by using the tool.

12. The method of cutting an elongate runner piece according to claim 1 wherein the first and second support surfaces are substantially flat and co-planar.

13. The method of cutting an elongate runner piece according to claim 1 wherein the support assembly comprises a first platform and further comprising the step of providing a second platform that is configured to accommodate a runner piece with a configuration different than is accommodated by the first platform and interchangeable with the first platform.

14. The method of cutting an elongate runner piece according to claim 1 further comprising the step of holding the cutting tool in one hand as the at least one cutting element is repositioned.

15. The method of cutting an elongate runner piece according to claim 1 wherein the receptacle is open vertically to allow the stem to be directed downwardly into the receptacle to place the runner piece in the cutting position.

* * * * *